US010246173B1

(12) United States Patent
Ingebritson

(10) Patent No.: US 10,246,173 B1
(45) Date of Patent: Apr. 2, 2019

(54) TILLERS FOR OUTBOARD MOTORS HAVING NEUTRAL SHIFT INTERLOCK MECHANISM

(71) Applicant: Brunswick Corporation, Lake Forest, IL (US)

(72) Inventor: Jolayne K. Ingebritson, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 372 days.

(21) Appl. No.: 15/254,598

(22) Filed: Sep. 1, 2016

(51) Int. Cl.
*B63H 20/12* (2006.01)
*B63H 20/16* (2006.01)
*B63H 20/20* (2006.01)

(52) U.S. Cl.
CPC ..... *B63H 20/16* (2013.01); *B63H 20/12* (2013.01); *B63H 20/20* (2013.01)

(58) Field of Classification Search
CPC ..... B63H 20/12; B63H 20/16; B63H 20/20
See application file for complete search history.

(56) References Cited

U.S. PATENT DOCUMENTS 3,636,911 A 1/1972 Piazza
D276,811 S 12/1984 Wolfe
4,496,326 A 1/1985 Boda
4,521,201 A 6/1985 Watanabe
4,582,493 A 4/1986 Toyohara
4,650,429 A 3/1987 Boda
4,701,141 A 10/1987 Sumigawa
D295,867 S 5/1988 Walsh
4,878,468 A 11/1989 Boda et al.
5,145,427 A 9/1992 Kawai
5,340,342 A 8/1994 Boda et al.
5,545,064 A * 8/1996 Tsunekawa ..... B63H 21/265 440/53
5,632,657 A 5/1997 Henderson
D380,478 S 7/1997 Robbins
6,010,563 A 1/2000 Taketani et al.
6,020,563 A 2/2000 Risk et al.
6,146,221 A 11/2000 Natsume
6,264,516 B1 7/2001 McEathron et al.
6,336,835 B1 * 1/2002 Naganuma ..... B63H 20/12 440/53
6,352,456 B1 * 3/2002 Jaszewski ..... B63H 20/10 440/53

(Continued)

*Primary Examiner* — S. Joseph Morano
*Assistant Examiner* — Jovon E Hayes
(74) *Attorney, Agent, or Firm* — Andrus Intellectual Property Law, LLP

(57) ABSTRACT

A tiller is for an outboard motor and has a manually operable shift mechanism configured to actuate shift changes in a transmission of the outboard motor amongst a forward gear, reverse gear, and neutral gear. The tiller also has a manually operable throttle mechanism configured to position a throttle of an internal combustion engine of the outboard motor into and between the idle position and a wide-open throttle position. An interlock mechanism is configured to prevent a shift change in the transmission out of the neutral gear when the throttle is positioned in a non-idle position. The interlock mechanism is further configured to permit a shift change into the neutral gear regardless of where the throttle is positioned.

20 Claims, 8 Drawing Sheets

(56) References Cited

U.S. PATENT DOCUMENTS

| | | | | |
|---|---|---|---|---|
| 6,352,457 | B1 * | 3/2002 | Higby | B63H 21/213 440/86 |
| 6,406,342 | B1 | 6/2002 | Walczak et al. | |
| 6,902,450 | B2 | 6/2005 | Ohtsuki | |
| 7,090,551 | B1 | 8/2006 | Lokken et al. | |
| D527,737 | S | 9/2006 | Iekura | |
| 7,160,160 | B2 * | 1/2007 | Kojima | B63H 20/10 114/144 R |
| 7,214,113 | B2 | 5/2007 | Kojima | |
| D552,129 | S | 10/2007 | Steinberg | |
| 7,442,104 | B2 * | 10/2008 | Okabe | B63H 20/08 440/53 |
| 7,455,558 | B2 | 11/2008 | Yander | |
| D611,501 | S | 3/2010 | Vignau et al. | |
| D611,502 | S | 3/2010 | Vignau et al. | |
| 7,677,938 | B2 | 3/2010 | Wiatrowski et al. | |
| 7,704,110 | B2 | 4/2010 | Wiatrowski et al. | |
| 7,895,959 | B1 | 3/2011 | Angel et al. | |
| 7,976,354 | B2 * | 7/2011 | Kubota | B63H 20/007 440/63 |
| D655,308 | S | 3/2012 | Steinberg | |
| 8,257,122 | B1 | 9/2012 | Holley | |
| 9,422,045 | B2 | 8/2016 | Kinpara | |
| 9,776,698 | B2 * | 10/2017 | Miyatake | B63H 20/00 |
| 9,896,176 | B2 * | 2/2018 | Suzuki | B63H 20/20 |
| 2001/0046819 | A1 * | 11/2001 | Kawai | B63H 21/21 440/84 |
| 2004/0137806 | A1 | 7/2004 | Ohtsuki | |

* cited by examiner

TILLERS FOR OUTBOARD MOTORS HAVING NEUTRAL SHIFT INTERLOCK MECHANISM

FIELD

The present disclosure relates to outboard motors, and particularly to tillers for outboard motors.

BACKGROUND

The following U.S. Patents are incorporated herein by reference, in entirety:

U.S. Pat. No. 8,257,122 discloses a multi-function throttle shaft that combines motor speed-control and motor direction-control in one tiller handle. Co-functionally, the throttle shaft is rotated clockwise/counterclockwise to control motor speed while intuitively allowing the user to push the throttle in for reverse direction and pull the throttle out for forward direction or vise-versa, based on whether the trolling motor is mounted on the transom or bow of a boat. In either case, the handle is always moved in the same direction that the operator wants the boat to travel.

U.S. Pat. No. 7,895,959 discloses advanced steering system designs for marine vessels, which incorporate non-linear tiller arms for rudder control, designed for creating different turning radii for discrete rudders. Differential tillers are utilized to create distinct angular displacement of the separate rudders in turning maneuvers, which enhance control and maneuverability of the marine vessels.

U.S. Pat. No. 7,090,551 discloses a tiller arm provided with a lock mechanism that retains the tiller arm in an upwardly extending position relative to an outboard motor when the tiller arm is rotated about a first axis and the lock mechanism is placed in a first of two positions. Contact between an extension portion of the lock mechanism and the discontinuity of the arm prevents the arm from rotating downwardly out of its upward position.

U.S. Pat. No. 6,406,342 discloses a control handle for a tiller of an outboard motor provided with a rotatable handle grip portion that includes an end surface which supports a plurality of push buttons that the operator of a marine vessel can depress to actuate certain control mechanisms and devices associated with the outboard motor. These push buttons include trim up and trim down along with gear selector push buttons in a preferred embodiment of the present invention.

U.S. Pat. No. 6,264,516 discloses an outboard motor provided with a tiller handle that enables an operator to control the transmission gear selection and the throttle setting by rotating the hand grip of the tiller handle. It also comprises a means for allowing the operator to disengage the gear selecting mechanism from the manually operable throttle mechanism. This allows the operator to manipulate the throttle setting without having to change the gear setting from neutral position.

U.S. Pat. No. 5,632,657 discloses a movable handle mounted to a trolling motor head. The handle is pivotally adjustable upwardly and downwardly to suit different positions of a fisherman while controlling the trolling motor. The handle spans across the motor head and acts as a tiller for pivoting the motor about its axis. The resistance to positional changes is adjustable and protective features are provided to prevent damage to the adjustment mechanism in the event of tightening. The handle incorporates therein various controls for the motor head.

U.S. Pat. No. 5,340,342 discloses a tiller handle provided for use with one or more push-pull cables inner-connected to the shift and the manually operable throttle mechanisms of an outboard marine engine to control the shift and the throttle operations of the engine. The tiller handle includes a rotatable cam member with one or more cam tracks located on its outer surface. Each push-pull cable is maintained within a distinct cam track such that rotating the rotatable cam member actuates the push-pull cables thereby controlling the operation of the shift and the manually operable throttle mechanisms of the engine.

U.S. Pat. No. 4,878,468 discloses an outboard marine motor housed by a cowl assembly having an upper cowl section and a lower cowl section that includes various features for improving the structural integrity of the cowl assembly and for providing a water-resistant seal at the joint between the cowl sections and at various points of entry of cables and other mechanical devices. A cut-out portion in the side of the lower cowl assembly is adapted to receive various cables and shift levers for different configurations of outboard marine motors, e.g. a manual tiller-operated motor including shift controls, a manual tiller-operated motor having a separate shift lever, and a remote-control motor having throttle and shift cables leading into the engine cavity. A sealing mechanism is provided at the cut-out portion of the lower cowl assembly, to provide a water-resistant seal at the points of entry of the cables or shift lever through the lower cowl section.

U.S. Pat. No. 4,496,326 discloses a steering system for a marine drive having a propulsion unit pivotally mounted on the transom of a watercraft and a tiller. The steering system includes a steering vane rotatably mounted on the propulsion unit for generating hydrodynamic forces to pivot or assist in pivoting the propulsion unit and to counteract propeller torque. A mount interposed between the propulsion unit and the tiller mounts the tiller for movement relative to the propulsion unit. A cable connects the tiller to the steering vane so that movement of the tiller with respect to the propulsion unit rotates the vane. The mount includes mutually engageable elements that can lock the tiller against movement relative to the propulsion unit so that the tiller may be used to directly steer the propulsion unit, if desired. For this purpose, the elements of the mount may be engaged by applying a downward pressure on the tiller.

U.S. patent application Ser. No. 15/236,534, filed Aug. 15, 2016, discloses a tiller for an outboard motor. The tiller comprises a supporting chassis having a first end and an opposite, second end. A rotatable throttle grip is supported on the first end and a pivot joint is located at the second end. The pivot joint is configured to facilitate pivoting of the tiller at least into and between a horizontal position wherein the supporting chassis extends horizontally and a vertical position wherein the supporting chassis extends vertically. A top cover is located on the supporting chassis. The top cover and the supporting chassis together define an interior of the tiller. The top cover is located vertically on top of the supporting chassis when the tiller is in the horizontal position.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In certain examples, a tiller for an outboard motor has a manually operable shift mechanism configured to actuate shift changes in a transmission of the outboard motor amongst a forward gear, reverse gear, and neutral gear. The tiller also has a manually operable throttle mechanism configured to position a throttle of an internal combustion engine of the outboard motor into and between the idle position and a wide-open throttle position. An interlock mechanism is configured to prevent a shift change in the transmission out of the neutral gear when the throttle is positioned in a non-idle position or at a low idle limit. The interlock mechanism is further configured to permit a shift change into the neutral gear regardless of where the throttle is positioned.

BRIEF DESCRIPTION OF THE DRAWINGS

The present disclosure is provided with reference to the following drawing Figures. The same reference numbers are used throughout the drawing Figures to reference like features and like components.

DETAILED DESCRIPTION OF THE DRAWINGS

Figure 1:
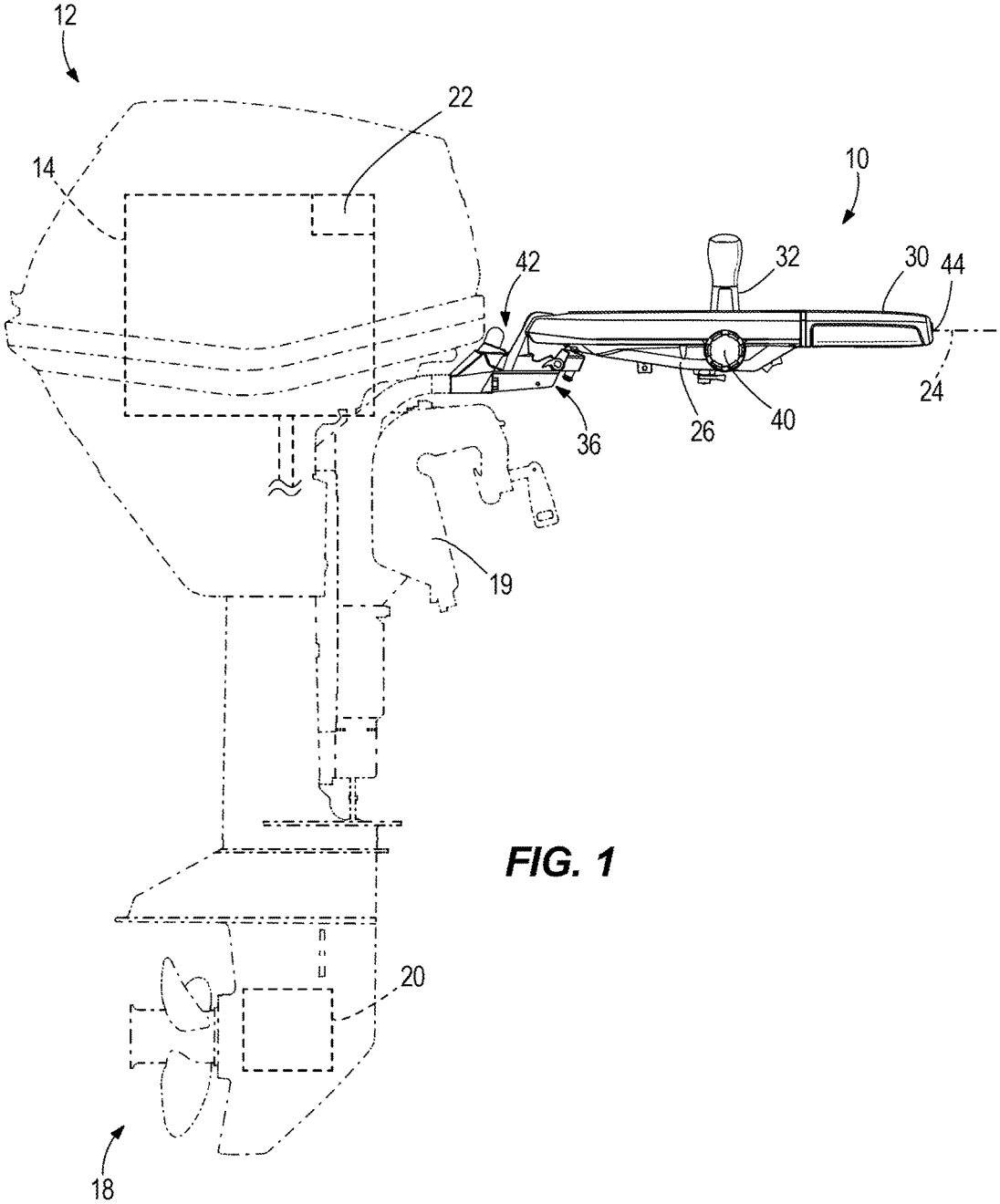
FIG. 1 depicts a exemplary embodiment of a tiller on an outboard motor.
Figure 2:
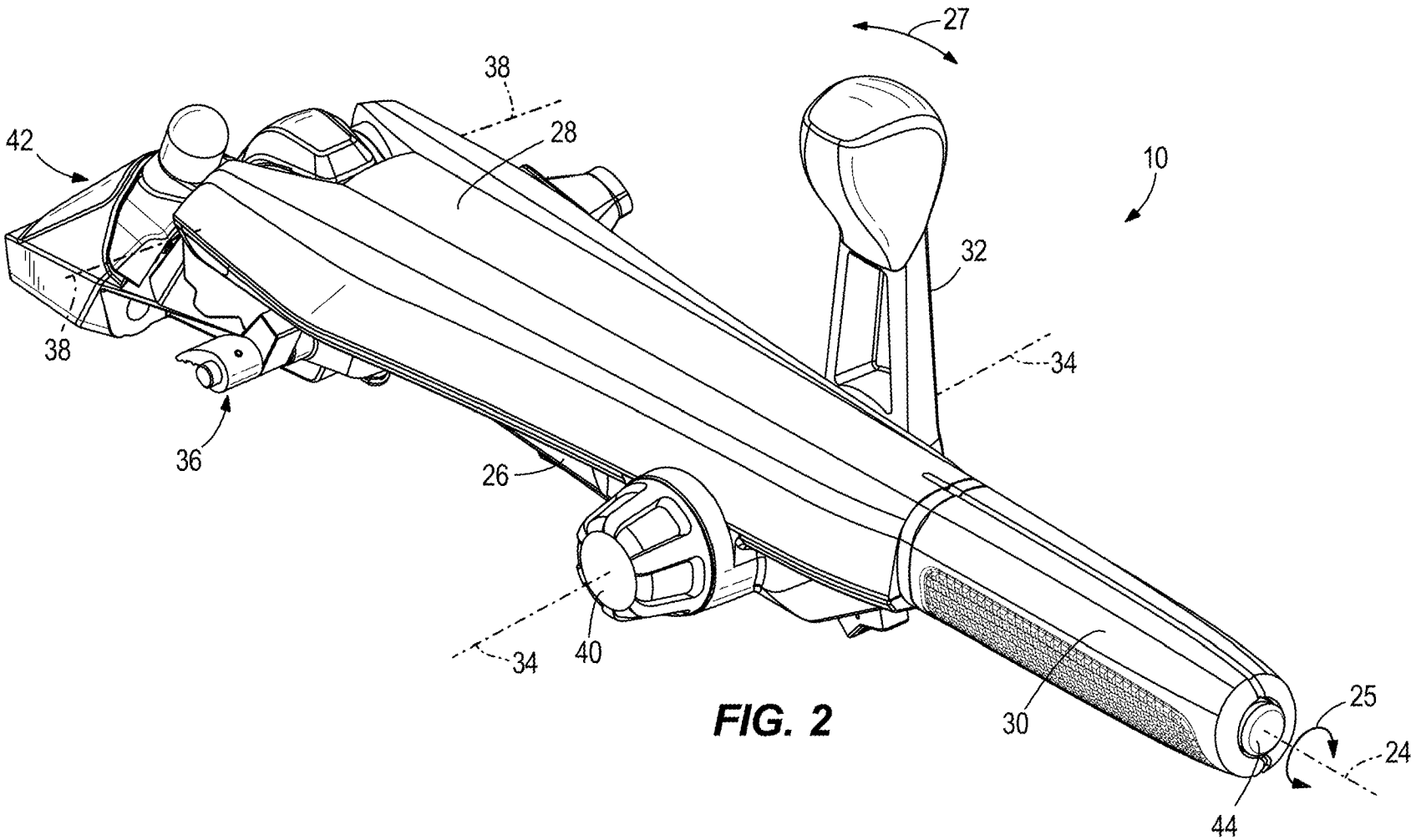
FIG. 2 is a perspective view of the tiller.

FIGS. 1 and 2 depict an improved tiller 10 that provides manual control of a conventional outboard motor 12. The type and configuration of the outboard motor 12 is exemplary and can vary from that which is shown. As is conventional, the outboard motor 12 has an internal combustion engine 14 that is configured to cause rotation of a driveshaft 16. The driveshaft 16 is operably connected to a propeller 18 via a conventional transmission 20. The transmission 20 is positionable into a forward gear in which rotation of the driveshaft 16 causes forward rotation of the propeller 18 to thereby forwardly propel a marine vessel (not shown) to which the outboard motor 12 is connected via a conventional transom bracket 19. The transmission 20 is further positionable into a reverse gear in which rotation of the driveshaft 16 causes reverse rotation of the propeller 18 to thereby reversely propel the marine vessel. The transmission 20 is further positionable into a neutral gear, in which the driveshaft 16 is operably disconnected from and thus rotation of the driveshaft 16 does not cause rotation of the propeller 18 or causes relatively slow rotation of the propeller 18. The internal combustion engine 14 includes a conventional throttle 22, which is positionable into and between an idle position wherein the internal combustion engine 14 operates the driveshaft 16 at an idle speed wherein little or no propulsive force is applied to the marine vessel by the propeller 18 and a wide open throttle position wherein the internal combustion engine 14 operates the driveshaft 16 at a maximum speed such that a maximum thrust is placed on the marine vessel by the propeller 18.

Referring to FIG. 2, the tiller 10 is elongated along a tiller axis 24 and has a base chassis 26, a top cover 28, and a throttle grip 30 that is manually rotatable about the tiller axis 24 (see arrow 25) to thereby control the position of the throttle 22, as described further herein below. The tiller 10 further includes a shift handle 32 that is manually pivotable about a shift handle axis 34 (see arrow 27) to thereby cause a shift change in the transmission 20 amongst the forward gear, reverse gear and neutral gear, as described further herein below. The tiller 10 can have additional, optional components including but not limited to a tilt ratchet lever mechanism 36 for manually pivoting and controlling position of the tiller 10 about a tilt axis 38; a locking knob 40 for manually locking a rotational position of the throttle grip 30, to thereby allow for hands-free operation of the throttle functionality of the tiller 10; a yaw pivot joint 42, which optionally can be configured to allow for pivoting motion of the tiller 10 about a vertical axis when the tiller 10 is in the horizontal position depicted in FIG. 2; a kill switch 44 located at the free end of the tiller for manually killing the internal combustion engine 14; and/or other conventional, optional components. Examples of many of the above-described optional components are provided in the above-incorporated U.S. patent application Ser. No. 15/236,534.

Figure 3:
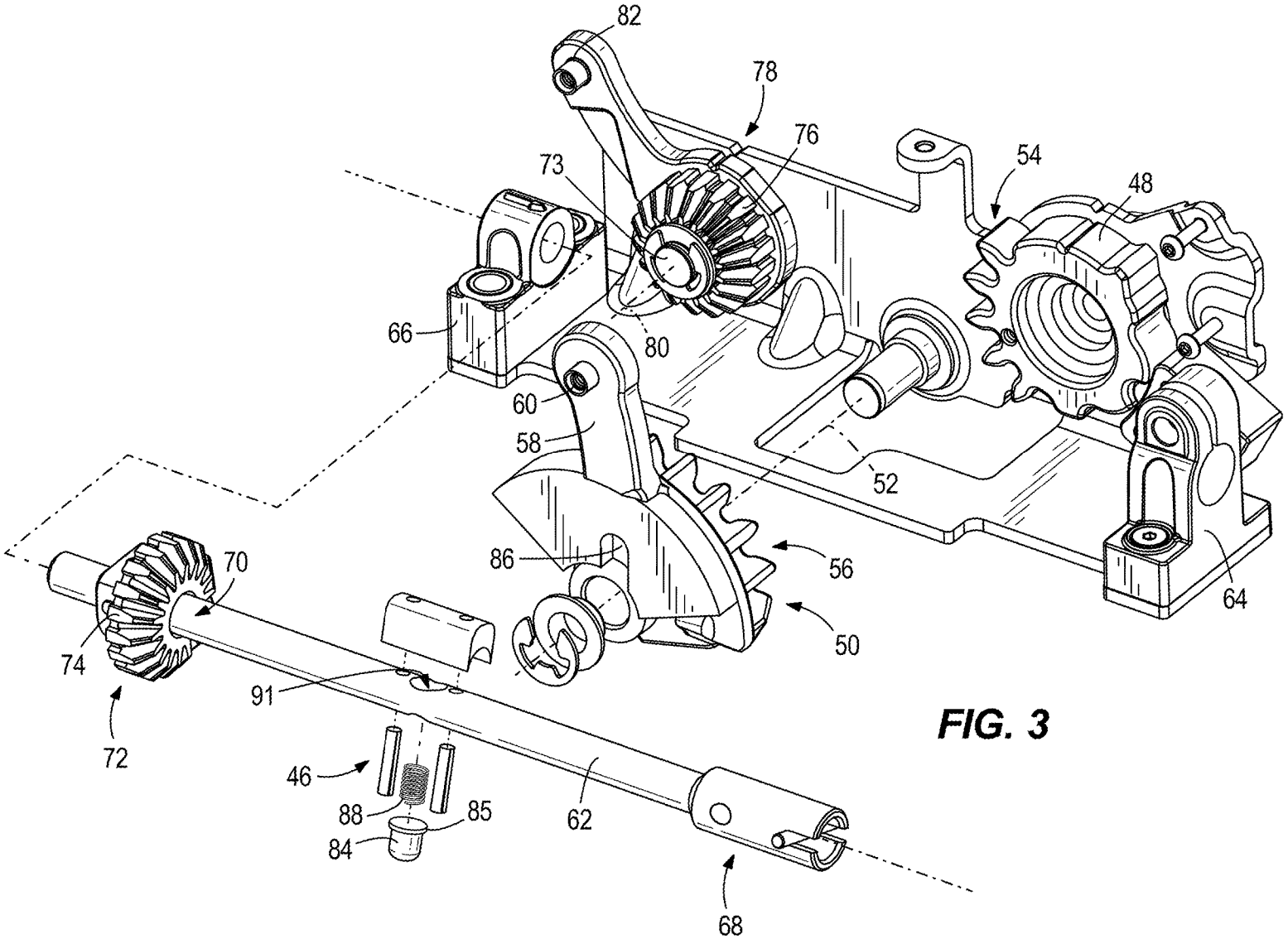
FIG. 3 is an exploded view of portions of the tiller including a manually operable shift mechanism, a manually operable throttle mechanism, and an interlock mechanism.

FIG. 3 depicts portions of a manually operable shift mechanism that is configured to actuate shift changes in the transmission 20 amongst the noted forward gear, reverse gear and neutral gear. FIG. 3 also depicts portions of a manually operable throttle mechanism that is configured to position the throttle 22 into and between the noted idle position and wide open throttle position. FIG. 3 also depicts an interlock mechanism 46 according to the present disclosure. As further described herein below, the interlock mechanism 46 is configured to prevent a shift change out of the neutral gear when the throttle 22 is positioned out of the idle position. The interlock mechanism 46 is also uniquely configured to permit a shift change into the neutral gear regardless of the position of the throttle 22. Through research and experimentation, the present inventors have found this combination to be advantageous, as described herein below.

Referring to FIG. 3, the shift mechanism includes a shift gear 48 disposed in the base chassis 26. The shift gear 48 is connected to the shift handle 32 through the base chassis 26 such that rotation of the shift handle 32 about the shift handle axis 34 causes commensurate rotation of the shift gear 48 about the shift handle axis 34. The manner in which the shift handle 32 and base chassis 26 are rotationally fixed together can vary and for example can include for example via a central pivot shaft that extends through the base chassis 26. The shift mechanism further includes a shift arm 50 that is disposed in the base chassis 26 next to the shift gear 48. The shift arm 50 is pivotable back and forth about a shift arm axis 52 (see arrow 90 in FIG. 4) via its connection to the base chassis 26 on a shift arm shaft 53. The shift gear 48 has radially outwardly projecting gear teeth 54 that are meshed with corresponding radially outwardly projecting gear teeth 56 on the shift arm 50 such that rotation of the shift gear 48 about the shift handle axis 34 causes opposite rotation of the shift arm 50 about the shift arm axis 52. The shift arm 50 has a radially extending lever arm 58 having a cable attachment point 60 at its free end 61. The cable attachment point 60 is configured to connect with a conventional push-pull cable (not shown). As is conventional, rotation of the shift arm 50 about the shift arm axis 52 pushes or pulls on the not shown push-pull cable, which causes corresponding shift changes in the transmission 20, as is conventional. The push-pull cable and its connection to and operation with the transmission 20 are well known to those having ordinary skill in the art and thus are not further described herein for brevity's sake. Examples of this type of conventional arrangement are provided in the above-incorporated U.S. Pat. No. 5,340,342.

With continued reference to FIG. 3, the throttle mechanism has a throttle shaft 62 which is manually rotatable about the tiller axis 24 to move the throttle 22 into and between the idle position and the wide open throttle position. The throttle shaft 62 is rotationally supported at its opposite ends by supporting yolks 64, 66. The first end 68 of the throttle shaft 62 is fixed to the throttle grip 30 such that rotation of the throttle grip 30 causes commensurate rotation of the throttle shaft 62. A throttle gear 72 is fixed to the second end 70 of the throttle shaft 62 such that rotation of the throttle shaft 62 causes commensurate rotation of the throttle gear 72. A throttle arm 78 is disposed in the base chassis 26 and is rotatable about a throttle arm axis 80 via a throttle arm shaft 73. The throttle gear 72 has radially outwardly protruding gear teeth 74 that mesh with corresponding radially outwardly protruding gear teeth 76 on a throttle arm 78 such that rotation of the throttle gear 72 causes rotation of the throttle arm 78 about a throttle arm axis 80. The throttle arm 78 has a cable attachment point 82 to which a push pull throttle cable (not shown) is attached. As is conventional, rotation of the throttle arm 78 about the throttle arm axis 80 pushes and/or pulls on the not shown push-pull cable, which causes corresponding changes in position of the throttle 22. The push-pull cable and its connection to and operation with the throttle 22 are known to those having ordinary skill in the art and thus are not further described herein for brevity's sake. Examples of this type of conventional arrangement are provided in the above-incorporated U.S. Pat. No. 5,340,342.

In the illustrated example, the interlock mechanism 46 includes a plunger 84 disposed on the throttle shaft 62 of the throttle mechanism and a recess 86 disposed on the sidewall 89 of the shift arm 50 of the shift mechanism. The plunger 84 is positioned between the first and second ends 68, 70 of the throttle shaft 62 and specifically is positioned to cooperate with the recess 86 in the sidewall 89 of the shift arm 50 when the throttle shaft 62 is rotated about its own axis. As further described herein below, engagement between the plunger 84 and the recess 86 prevents a shift change in the transmission 20 out of neutral gear. That is, engagement between the plunger 84 and the recess 86 prevents manual pivoting of the shift handle 32 about the shift handle axis 34. Disengagement between the plunger 84 and the recess 86 operationally separates the shift mechanism and the throttle mechanism and thus allows a shift change in the transmission regardless of throttle position. As described below, the interlock mechanism 46 is specially configured such that the plunger 84 engages with the recess 86 when the transmission 20 is in neutral gear and the throttle 22 is out of the idle position, thereby preventing a shift change out of the neutral gear. In the illustrated example, the plunger 84 is reciprocally movable into and out of a cavity 91 formed in the throttle shaft 62. A spring 88 is configured to bias the plunger 84 out of the cavity 91, towards the recess 86, and particularly into the recess 86 when the transmission 20 is in the neutral gear and the throttle mechanism locates the throttle 22 out of the idle position or a low idle position. The plunger 84 has a perimeteral end flange 85 that engages with an interior ledge 83 (see FIG. 7) in the cavity 91 so that the plunger 84 remains in the cavity 91, retained between the interior ledge 83 and the spring 88. In the illustrated example, an end cap 77 and fasteners 79 are configured to retain the plunger 84 and spring 88 in the cavity 91. The manner in which the plunger 84 and spring 88 are connected to the throttle shaft 62 can vary from that which is shown and described.

Operation of the interlock mechanism 46 in conjunction with the noted shift and throttle mechanisms will now be described with reference to FIGS. 4-8.

Figure 4:
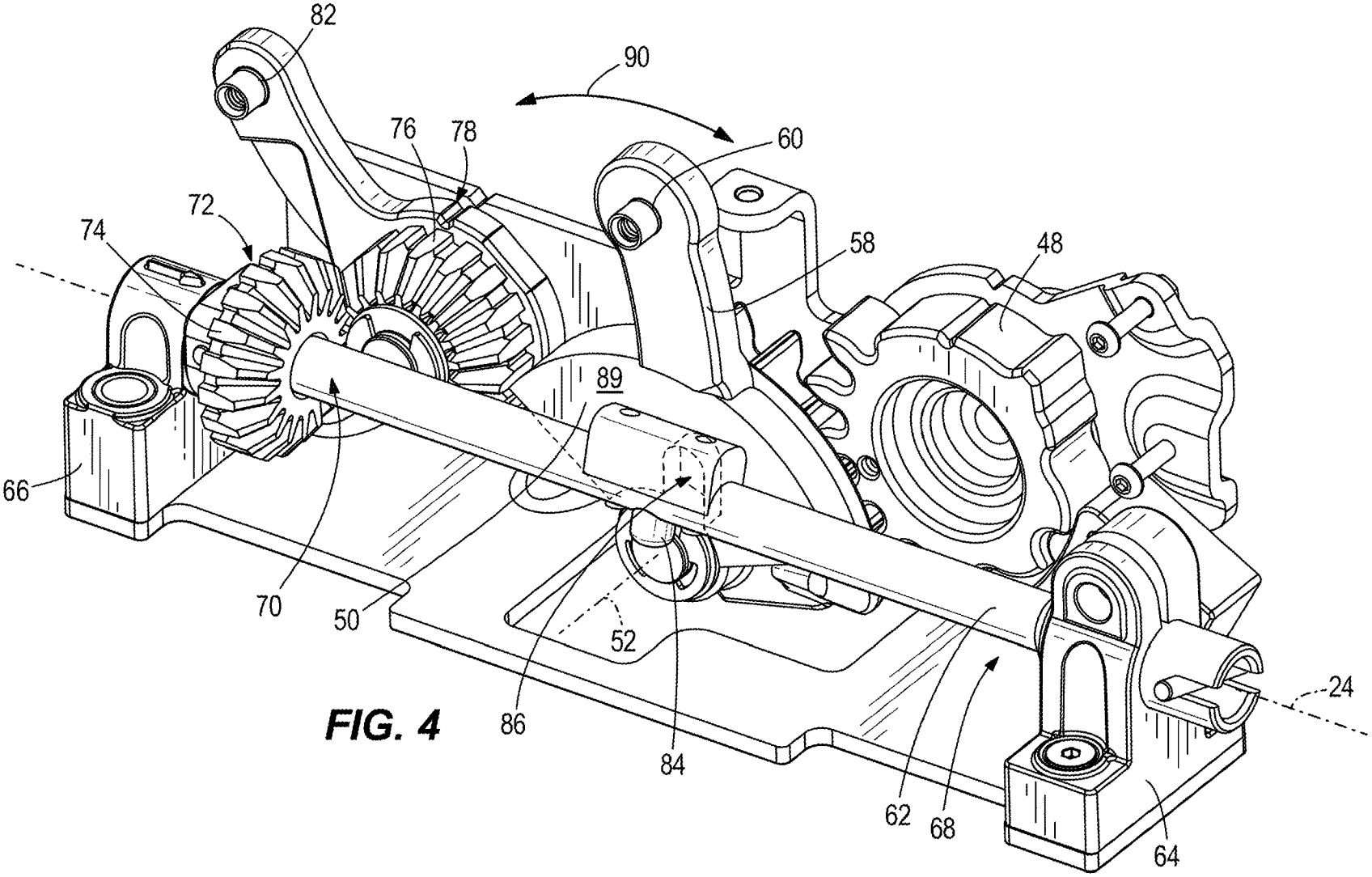
FIG. 4 depicts the shift mechanism in a neutral gear and the throttle mechanism in an idle position.

FIG. 4 depicts the shift mechanism in a neutral gear position, wherein the transmission 20 is in neutral gear. FIG. 4 also depicts the throttle mechanism in an idle gear position, wherein the throttle 22 is positioned to control the internal combustion engine 14 at idle speed. In the idle speed position, the plunger 84 extends radially downwardly from the throttle shaft 62 (as shown in FIG. 4) and is not engaged in the recess 86 in the sidewall 89 of the shift arm 50. In this position, the shift handle 32 (FIG. 2) and corresponding shift arm 50 are both freely rotatable away from their depicted positions. That is, the shift arm 50 is freely pivotable about the shift arm axis 52 to thereby engage the transmission 20 in forward or reverse gear. The throttle grip 30 is also freely rotatable about the tiller axis 24 to thereby reposition the throttle 22 to control the internal combustion engine 14 at an above-idle or low speed. In other words, the interlock mechanism 46 is not engaged between the shift and throttle mechanisms and thus the shift and throttle mechanisms are operably separated.

Figure 5:
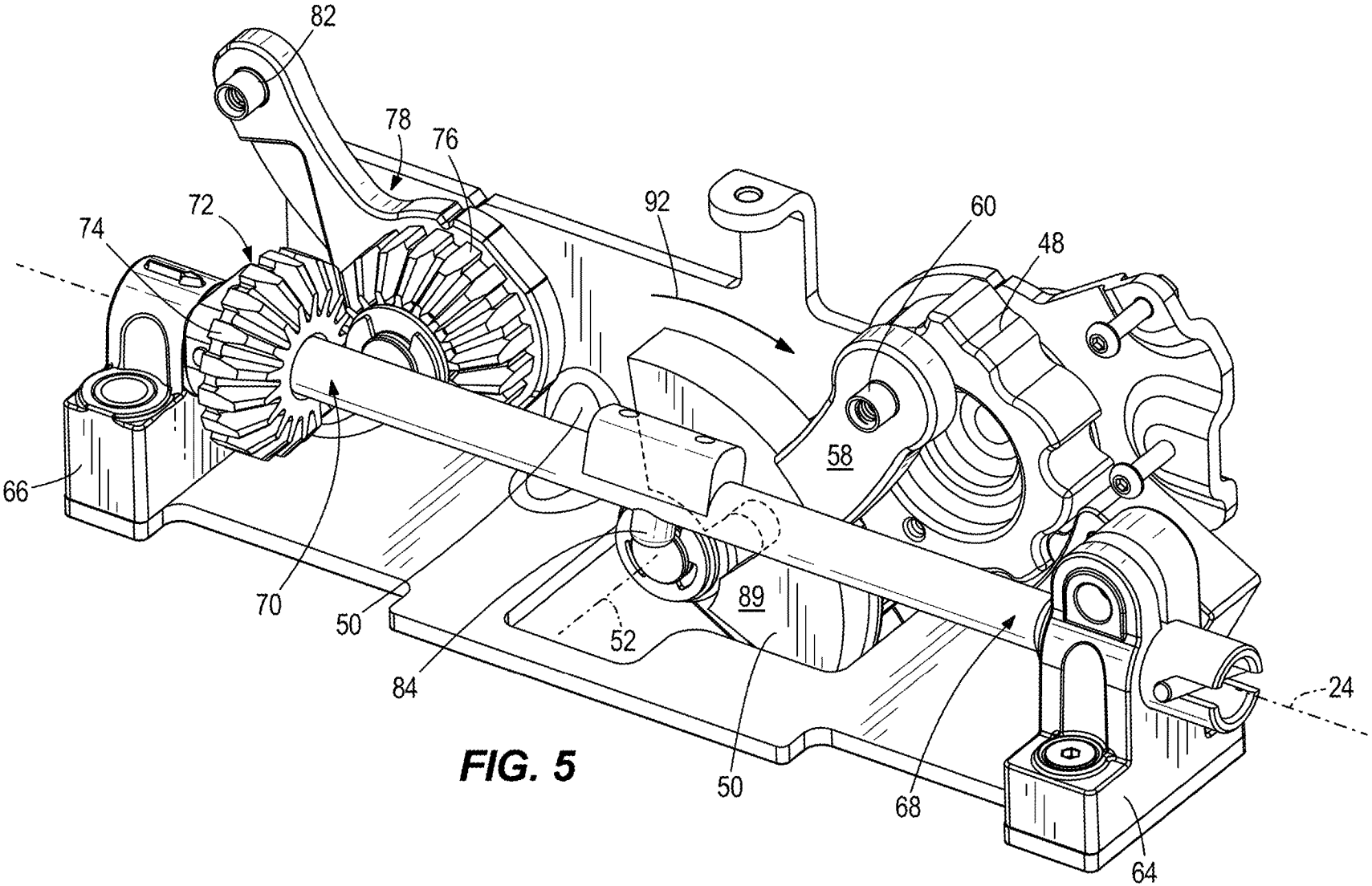
FIG. 5 depicts the manually operable shift mechanism in a forward gear and the throttle mechanism in an idle position.

Now comparing FIG. 4 to FIG. 5, FIG. 5 depicts a forward gear position wherein the shift handle 32 (FIG. 2) has been manually rotated forwardly about the shift handle axis 34 to thereby rotate the shift arm 50 forwardly about the shift arm axis 52, as shown at arrow 92. This causes a corresponding shift change in the transmission 20 into forward gear via the not shown push-pull cable. The throttle mechanism remains in the neutral gear position, as shown and described herein above regarding FIG. 4. The interlock mechanism 46 remains disengaged (as described above) and thus the shift and throttle mechanisms remain operably separated. In these relative positions, the shift handle 32 (FIG. 2) and the corresponding shift arm 50 can be freely pivoted back to the neutral position shown in FIG. 4 to place the transmission 20 back into neutral gear. The shift handle 32 and corresponding shift arm 50 can be further pivoted towards a reverse position (i.e. past the neutral position) to shift the transmission 20 into reverse gear. Alternately, the throttle grip 30 (FIG. 2) and the corresponding throttle shaft 62 can be rotated away from depicted idle position to open the throttle 22 in the internal combustion engine 14.

Figure 6:
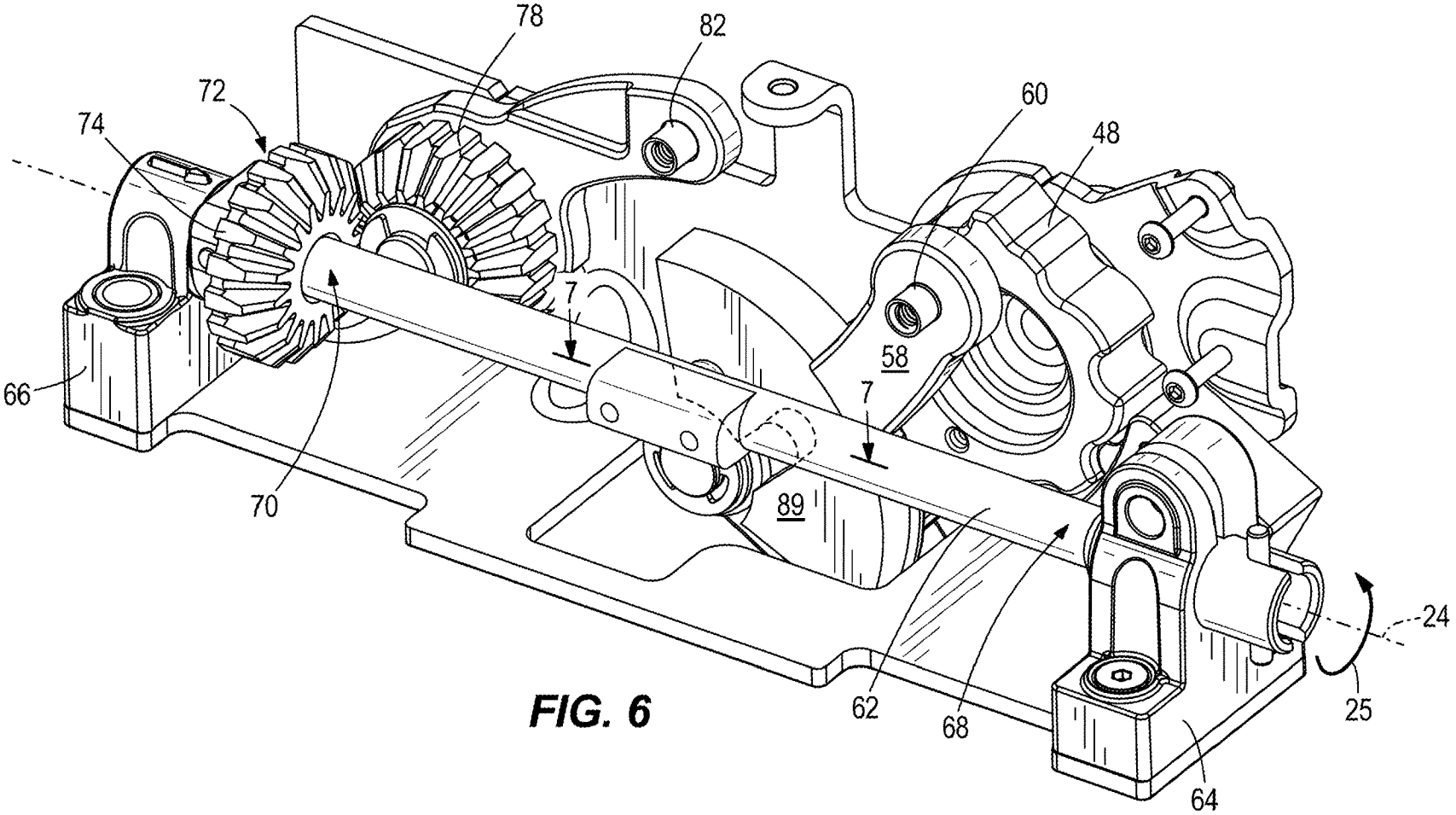
FIG. 6 depicts the manually operable shift mechanism in a forward gear and the throttle mechanism in a wide open throttle position.
Figure 7:
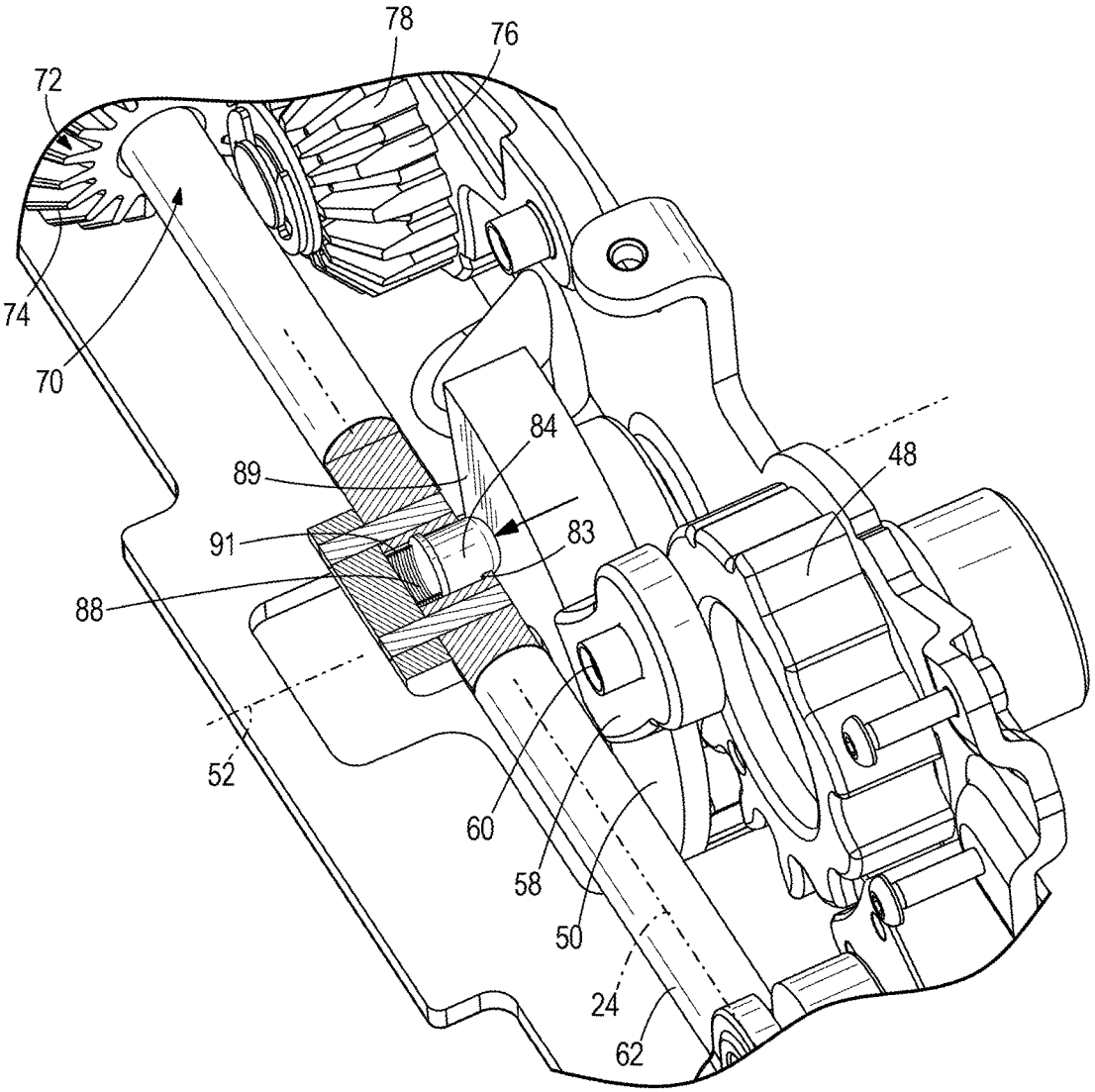
FIG. 7 is a view of Section 7-7, taken in FIG. 6.

FIGS. 6 and 7 depict the tiller 10 after the operator has rotated the throttle grip 30 (see arrow 25; FIG. 2) to advance the position of the throttle 22 above idle or low speed. Specifically, the throttle grip 30 has been rotated about the tiller axis 24 into a wide open throttle position wherein the throttle 22 is wide open. Rotation of the throttle grip 30 rotates the throttle shaft 62 and thus orients the plunger 84 towards the sidewall 89 of the shift arm 50. Since the shift arm 50 is rotated into forward gear position, the plunger 84 engages with the sidewall 89 and is forced back into the cavity 91 against the bias of the spring 88 (see arrow 94). In this position, the shift handle 32 and corresponding shift arm 50 can be freely pivoted back to the neutral position shown in FIGS. 4 and 5, to place the transmission 20 back into neutral gear. Alternately, the throttle grip 30 and the corresponding throttle shaft 62 can be freely rotated back towards the idle position.

Figure 8:
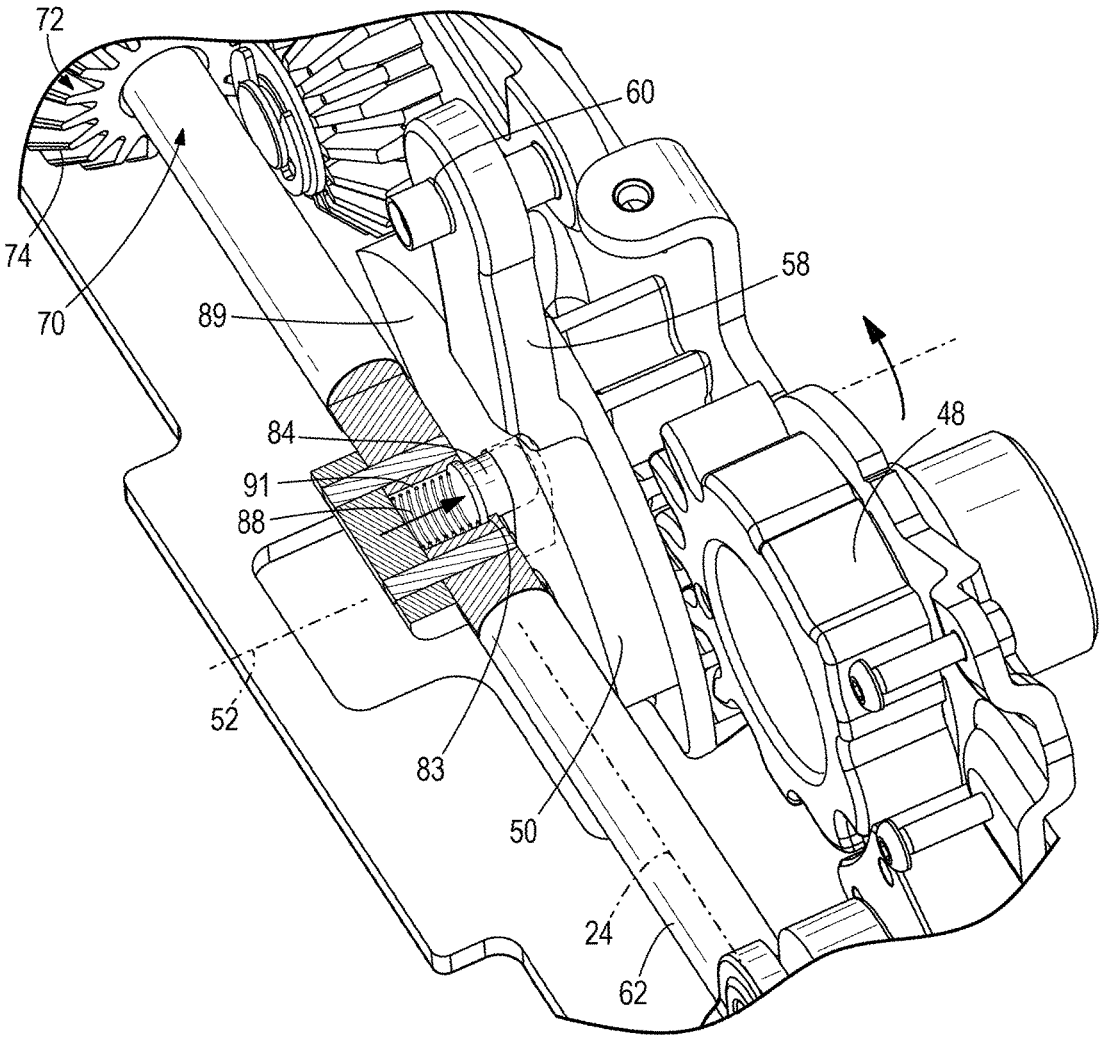
FIG. 8 is a view like FIG. 7, showing the shift mechanism in the neutral gear and the throttle mechanism in the wide open throttle position.

FIG. 8 depicts the shift arm 50 after the shift lever 32 has been manually moved back into a neutral position. The throttle shaft 62 has remained in the wide open throttle position shown and described herein above with reference to FIG. 6. When this occurs, the recess 86 in the sidewall 89 of the throttle arm becomes aligned with the plunger 84. The spring 88 biases the plunger 84 into the recess 86, as shown at arrow 96. Engagement between the plunger 84 and recess 86 prevents any subsequent shift change until the operator rotates the throttle grip 30 to move the throttle mechanism back into the idle position, shown in FIG. 5. Specifically, engagement between the plunger 84 and recess 86 prevents rotation of the shift arm 50 about the shift arm axis 52. Subsequent rotation of the throttle grip 30 moves causes corresponding rotation of the throttle shaft 62 such that the plunger 84 is rotated downwardly, out of the open lower end of the recess 86. This operationally separates the shift and throttle mechanisms (via the interlock mechanism 46) and allows for independent operation of the shift and throttle mechanisms. In certain examples, the size and/or contour of the recess 86 with respect to the size and/or contour of the plunger 84 can be specifically tailored so that the interlock mechanism permits a shift change at relatively low, non-idle speeds. For example, forming the recess 86 with a larger cross-section can allow for relative movement between the plunger 84 and the recess 86. In other examples, the recess 86 can have a tapered end surface (instead of a sharp edge on the surface of the sidewall 89), which can allow for relative movement between the plunger 84 and the recess 86. These features can allow the operator to perform a shift change at certain low, above idle speeds, wherein damage to the internal combustion engine 14 and/or shock to the passengers in the marine vessel are less likely.

The present disclosure thus advantageously provides an interlock mechanism that is configured to prevent a shift change out of the neutral gear when the throttle is positioned out of the idle position, wherein the interlock mechanism is configured to permit a shift change into the neutral gear regardless of throttle position. This provides significant advantages over the prior art, in which an operator can damage the engine or shift into gear while throttled high, and/or which may cause the marine vessel to move without the operator expecting it or prevent the operator from shifting out of gear at any throttle position if there is an urgent need to shift out of gear.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A tiller for an outboard motor having a transmission that is operable in a forward gear, a reverse gear, and a neutral gear, the outboard motor further having an internal combustion engine with a throttle that is positionable into and between an idle position and an open throttle position, the tiller comprising:

a manually operable shift mechanism that is configured to actuate shift changes in the transmission amongst the forward gear, reverse gear, and neutral gear;

a manually operable throttle mechanism that is configured to position the throttle into and between the idle position and the open throttle position; and an interlock mechanism that is configured to prevent a shift change out of the neutral gear when the throttle is positioned out of the idle position, wherein the interlock mechanism is further configured to permit a shift change into the neutral gear regardless of throttle position.

2. The tiller according to claim 1, wherein the interlock mechanism comprises a plunger on one of the manually operable shift mechanism and manually operable throttle mechanism and a recess on the other of the manually operable shift mechanism and manually operable throttle mechanism, wherein engagement between the plunger and the recess prevents the shift change out of the neutral gear when the throttle is positioned out of the idle gear.

3. The tiller according to claim 2, wherein the interlock mechanism is configured such that the plunger engages with the recess when the transmission is in the idle gear and the throttle is out of the idle position, thereby preventing the shift change out of the neutral gear.

4. The tiller according to claim 3, wherein movement of the throttle into the idle position forces the plunger from the recess and permits the shift change out of the neutral gear.

5. The tiller according to claim 4, further comprising a spring that biases the plunger into the recess.

6. The tiller according to claim 5, wherein movement of the throttle into the idle position forces the plunger out of the recess against the bias of the spring.

7. The tiller according to claim 1, wherein the manually operable shift mechanism comprises a shift arm that is rotatable about a shift arm axis, wherein rotation of the shift arm about the shift arm axis actuates the shift changes;

the manually operable throttle mechanism comprises a throttle shaft that extends along a throttle shaft axis, wherein rotation of the throttle shaft about the throttle shaft axis positions the throttle; and the interlock mechanism cooperates between the shift arm and the throttle shaft.

8. The tiller according to claim 7, wherein the interlock mechanism comprises a plunger on one of the shift arm and throttle shaft and a recess on the other of the shift arm and throttle shaft, wherein engagement between the plunger and the recess prevents the shift change out of the neutral gear.

9. The tiller according to claim 8, wherein the plunger and recess are configured such that the plunger engages with the recess when transmission is in the idle gear and the throttle is positioned out of the idle position, thereby preventing the shift change out of the neutral gear.

10. The tiller according to claim 9, wherein movement of the throttle into the idle position removes the plunger from the recess and permits the shift change out of the neutral gear.

11. The tiller according to claim 10, further comprising a spring that biases the plunger into the recess.

12. The tiller according to claim 11, wherein movement of the throttle into the idle position forces the plunger out of the recess against the bias of the spring.

13. The tiller according to claim 7, wherein the interlock mechanism comprises a plunger on the throttle shaft and a recess on the shift arm, wherein engagement between the plunger and the recess prevents the shift change out of the neutral gear.

14. The tiller according to claim 13, wherein the plunger radially extends from the throttle shaft and rotates about the throttle shaft axis into and out of engagement with the recess on the shift arm.

15. The tiller according to claim 14, wherein the plunger and recess are configured such that the plunger engages with the recess when transmission is in the idle gear and the throttle is positioned out of the idle position, thereby preventing the shift change out of the neutral gear.

16. The tiller according to claim 15, wherein movement of the throttle into the idle position removes the plunger from the recess and permits the shift change out of the neutral gear.

17. The tiller according to claim 16, further comprising a spring and biases the plunger into the recess.

18. The tiller according to claim 17, wherein movement of the throttle into the idle position forces the plunger out of the recess against the bias of the spring.

19. An outboard motor comprising:

a transmission that is operable in a forward gear, a reverse gear, and a neutral gear;

an internal combustion engine having a throttle that is positionable into and between an idle position and an open throttle position; and a tiller comprising:

a manually operable shift mechanism that is configured to actuate shift changes in the transmission amongst the forward gear, reverse gear, and neutral gear;

a manually operable throttle mechanism that is configured to position the throttle into and between the idle position and the open throttle position; and an interlock mechanism that is configured to prevent a shift change in the transmission from the neutral gear into at least one of the forward gear and the reverse gear when the throttle is positioned in a predetermined non-idle position, wherein the interlock mechanism is further configured to permit a shift change into the neutral gear regardless of throttle position.

20. The outboard motor according to claim 19, the manually operable shift mechanism comprising a shift arm that is rotatable about a shift arm axis, wherein rotation of the shift arm about the shift arm axis actuates the shift changes amongst the forward, neutral and reverse gears of the outboard motor; and the manually operable throttle mechanism comprising a throttle shaft that extends along a throttle shaft axis, wherein rotation of the throttle shaft about the throttle shaft axis positions the throttle of the outboard motor into and between the idle position and open throttle position; and wherein the interlock mechanism cooperates between the throttle shaft and the shift arm.

* * * * *